United States Patent [19]

Thorogood

[11] Patent Number: 4,699,209

[45] Date of Patent: Oct. 13, 1987

[54] HEAT EXCHANGER DESIGN FOR CRYOGENIC REBOILER OR CONDENSER SERVICE

[75] Inventor: Robert M. Thorogood, Macungie, Pa.

[73] Assignee: Air Products and Chemicals, Inc., Allentown, Pa.

[21] Appl. No.: 844,917

[22] Filed: Mar. 27, 1986

[51] Int. Cl.[4] ..... F28B 1/00

[52] U.S. Cl. ..... 165/110; 165/166

[58] Field of Search ..... 165/166, 167, 110

[56] References Cited

U.S. PATENT DOCUMENTS

| | | | |
|---|---|---|---|
| 3,545,062 | 12/1970 | Cox | 165/166 X |
| 3,792,842 | 2/1974 | Nakako et al. | 165/166 X |
| 3,840,070 | 10/1974 | Becker et al. | 165/167 |
| 3,931,854 | 1/1976 | Svakhnenko et al. | 165/166 |
| 4,124,069 | 11/1978 | Becker | 165/164 |
| 4,131,159 | 12/1978 | Long | 165/166 |
| 4,534,337 | 8/1985 | Janson | 165/166 X |

FOREIGN PATENT DOCUMENTS

| | | | |
|---|---|---|---|
| 0027456 | 4/1982 | European Pat. Off. | 165/166 |
| 1595511 | 1/1978 | United Kingdom | 165/166 |
| 2005398 | 9/1978 | United Kingdom | 165/166 |

*Primary Examiner*—Albert W. Davis, Jr.
*Assistant Examiner*—Peggy A. Neils
*Attorney, Agent, or Firm*—Willard Jones, II; James C. Simmons; E. Eugnene Innis

[57] ABSTRACT

The present invention is directed to a heat exchanger for reboiler or condenser service in a cryogenic distillation column (e.g. air separation) or other service in which small temperature differences between clean fluids are a primary objective. The exchanger comprises a stack of corrugated sheets having corrugations generally parallel to the diagonal between opposite corners of a sheet assembled with each sheet on an opposed diagonal to that of its neighbor, which provides for alternating condensing and boiling passages. These passages because of their configuration have increased primary heat transfer surfaces resulting in reduced temperature differences in the exchanger. Special edge configurations control boiling and condensing fluid flow patterns to maximize the heat transfer performance. Optionally, the heat exchanger can have an enhanced boiling surface applied to the boiling channel surface.

10 Claims, 9 Drawing Figures

HEAT EXCHANGER DESIGN FOR CRYOGENIC REBOILER OR CONDENSER SERVICE

FIELD OF INVENTION

The present invention relates to a heat exchanger for use in a cryogenic distillation column reboiler or condenser.

BACKGROUND OF THE INVENTION

Two designs of heat exchangers are presently in general use as reboilers and condensers in air separation and similar cryogenic applications.

The most common of these exchangers is the plate-fin brazed aluminum heat exchanger. In a typical heat exchanger: aluminum plates from about 0.03 to about 0.05 inches thick are separated by a corrugated aluminum sheet which serves to form a series of fins perpendicular to the plates and channels or flow paths arranged axially in the direction of the flow. Usually, the fin or corrugated sheets have a thickness of about 0.008 to about 0.012 inches with about 15 to about 25 fins per inch and a fin height of about 0.2 to about 0.3 inches. A heat exchanger is formed by brazing an assembly of alternate layers of flat plate and corrugated sheet with the first and last layer generally being a flat plate, with the edges enclosed by side bars.

This type exchanger is immersed in a bath of the liquid to be boiled with the parting sheet and fins oriented vertically. The boiling liquid enters a heat transfer passage (defined by the corrugation closed by a plate) through the open bottom of the heat exchange passage and the heated mixture of liquid and vapor exit from the open top of the passage. Alternative passages separated by the parting sheets contain the boiling and condensing fluids. In the condensing passage, vapor is introduced at the top through a manifold welded to the side of the exchanger and having an opening into alternate passages, defined by a corrugated sheet and adjacent plate. In each condensing passage, the vapor is distributed by a special arrangement of distributor fins. The condensate leaving the passages passes through an arrangement similar to the entering vapors. The disadvantages of this type of heat exchanger are the inability of the liquid and the vapor flows to easily redistribute in a direction perpendicular to their flow, the very close spacing of the fins in order to obtain a large secondary heat transfer surface, and the relatively large spacing between the parting sheets which limits the primary surface area for heat transfer.

A second type of heat exchanger, in current use, is the vertical shell and tube reboiler. To achieve a sufficiently low temperature difference in this design, the tube surfaces are coated with a porous enhanced boiling surface. The disadvantage of the shell and tube design is the limited heat transfer surface that can be accommodated in the distillation column.

A third heat exchanger construction is described in U.S. Pat. No. 3,840,070. This design utilizes a corrugated plate format in which plates of dissimilar geometry are stacked in pairs to form adjacent heat transfer channels for boiling and condensation. The design is asymmetric and would not generally be considered acceptable for oxygen boiling service because of the possibility of promoting dry boiling.

BRIEF SUMMARY OF THE INVENTION

The present invention is a heat exchanger for reboiler or condenser service in a cryogenic distillation column which comprises: a plurality of corrugated sheets of thermally conductive material, wherein the corrugations on each sheet are generally parallel to a diagonal between opposite corners of the sheet, with peripheral edges of each of said sheets flattened, said sheets disposed in a stack with each of said sheets having said corrugations on opposed diagonals, e.g. the longitudinal axes of the corrugations on one sheet is at an acute angle to that of the juxtaposed or neighbor sheets, thereby defining flow passages between adjacent sheets. The corrugated sheet surfaces form extended primary heat transfer surfaces, and the assembly includes means for joining said corrugated sheets; first means for closing a substantial portion of two of the parallel edges between alternating pairs of sheets; second means for closing the entire length of the parallel edges between the alternating sheets partially closed by said first means; and third means for closing the entire length of the parallel edges perpendicular to the edges closed by the first means.

DETAILED DESCRIPTION OF THE INVENTION

Figure 1:
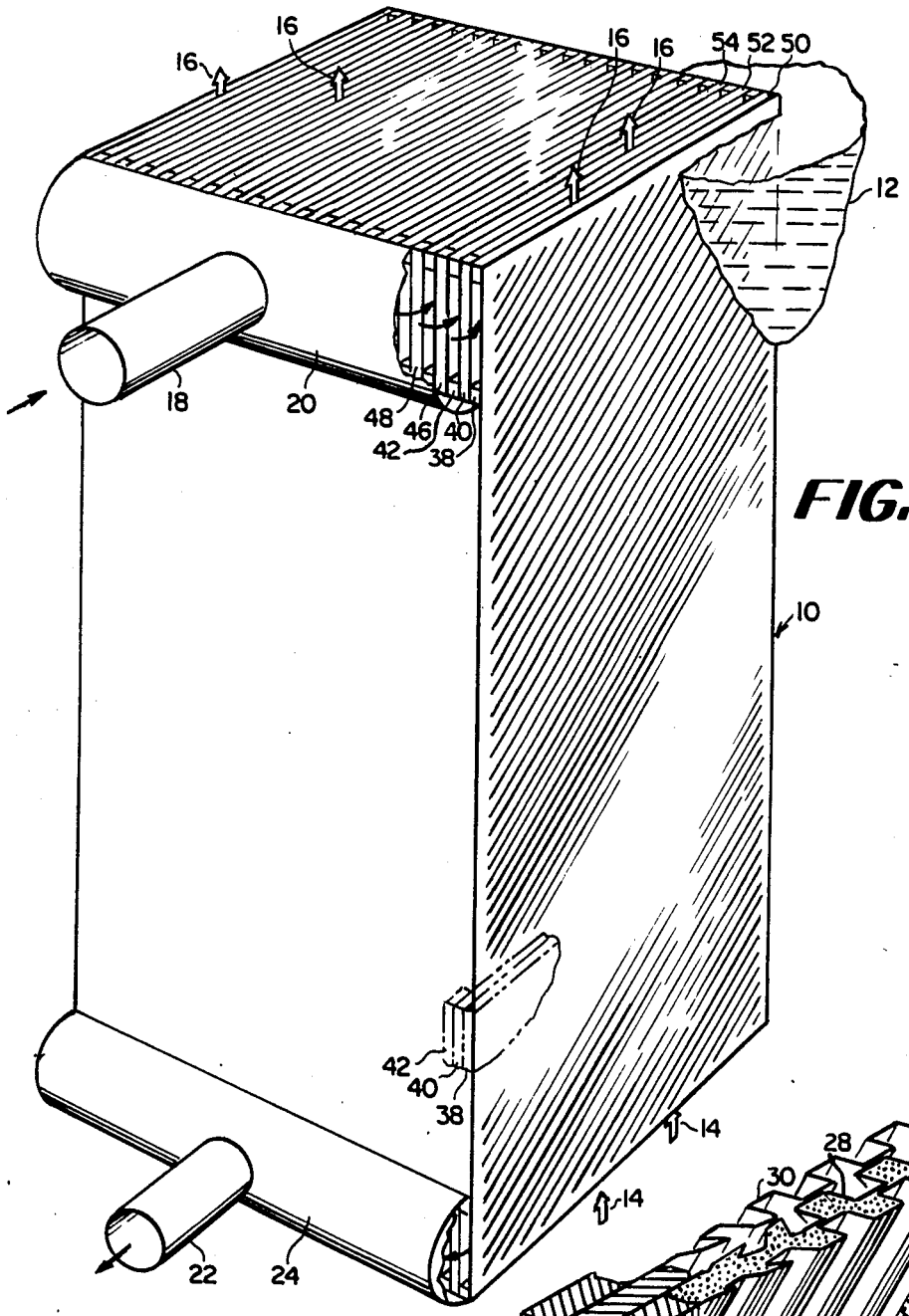
FIG. 1 is partially fragmented isometric view of the heat exchanger according to the invention assembled as a shown immersed in a bath of the boiling fluid.
Figure 2:
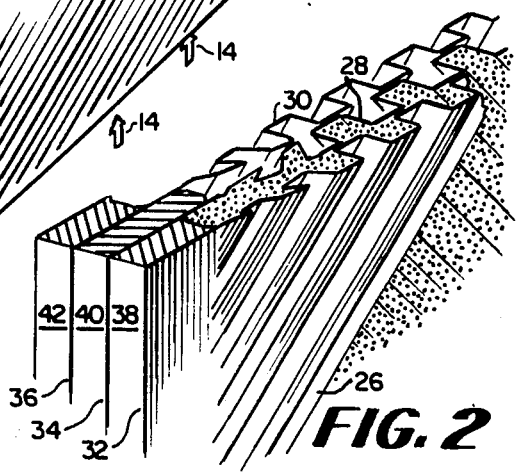
FIG. 2 is an enlarged detail of a portion of the heat exchanger of FIG. 1 showing a preferred form of the edge construction in which adjacent and diagonally opposed corrugated layers respectively containing boiling and condensing fluids are progressively flattened to be contained and supported between side bars.
Figure 3:
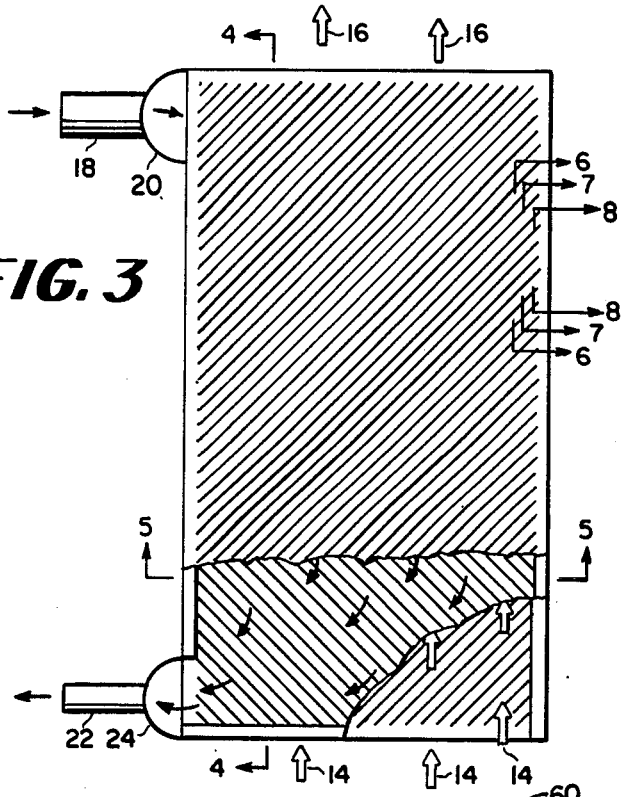
FIG. 3 is a side elevation of the heat exchanger of FIG. 1, partially fragmented to illustrate the lower condensing and boiling channels.
Figure 4:
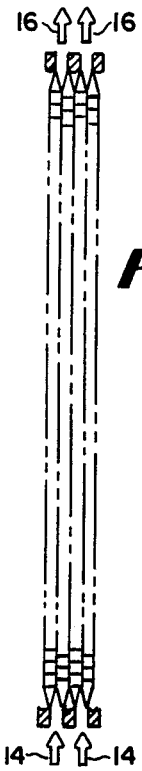
FIG. 4 is a section along line 4—4 of FIG. 3 illustrating adjacent flow channels for boiling and condensing.
Figure 5:
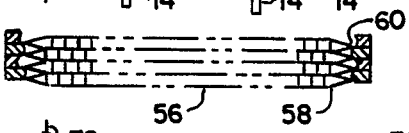
FIG. 5 is a partial horizontal section along line 5—5 of FIG. 3 illustrating flow channels for boiling and condensing.

With reference to FIGS. 1-5, heat exchanger 10, according to the present invention, is shown which increases the heat transfer efficiency between cryogenic boiling and condensing fluids such as oxygen and nitrogen. The general configuration of heat exchanger 10 is shown in FIG. 1 and is similar in arrangement of boiling and condensing channels to those found in conventional plate-fin brazed reboiler-condensers. The boiling channels are immersed in liquid bath 12 such that thermosyphon action may occur to draw liquid into the bottom of the boiling channels, as shown by arrows 14, with a mixture of liquid and vapor being expelled from the top of the channels, as shown by arrows 16. Condensing vapors are conducted to the tops of the condensing channels through conduit 18 and header 20 welded to the side of the heat exchanger and condensate is removed through a similar conduit 22 and header 24 at the bottom of heat exchanger 10. In heat exchanger 10, the heat transfer surface is formed from a plurality of flat corrugated sheets (26, 28 and 30) of a thermally conductive material as shown in FIG. 2. The corrugations of these sheets typically can have dimensions of about 0.05 to about 0.2 inches in height and from about three to about eight corrugations per inch. These sheets are assembled in contact with one another and with the longitudinal axes of the corrugation on opposed diagonals with those of its neighbor. The corrugated surfaces form extended primary heat transfer surfaces between the fluids on each side of the sheet. Two opposite edges (illustrated by edge 32, 34 and 36) of sheets 26, 28 and 30 are flattened so that they may be separated by rectangular bars 38, 40 and 42. These bars 38, 40 and 42 close in two sides of the sheet except that every other bar, e.g. 40, 46 and 48, is extended to form a closure so that different fluids can be directed between alternating flow paths defined by the corrugated sheets, e.g 26, 28 and 30. Sheets assembled in this manner would be disposed vertically in the heat exchanger of FIG. 1 with the condensing fluid paths defined by the sheets with the shorter bars there between. As shown in FIG. 1, the sheets with the shorter bars have top bars (e.g. 50, 52 and 54) to form a closure so that condensing fluid cannot mix with the boiling fluid. Manifolds 20 and 24 define the closed circulation path for the condensing fluid.

The corrugated dimensions and thickness are chosen such that after brazing there will be sufficient area and frequency of contact between sheets to withstand the condensing circuit pressure. For operating conditions such as those required in a conventional double column air separation plant, suitable dimensions are about 0.1 inches in height with about five corrugations to the inch and a plate thickness of about 0.012 to about 0.024 inches. A rectangular corrugation form permits a contact area between sheets for brazing of approximately 1.5 times the metal cross section between the contact zones, thus giving the required strength to withstand operating pressure.

Figure 6:
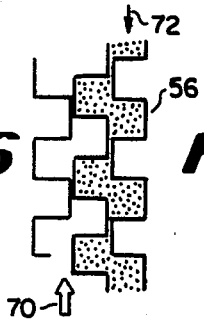
FIG. 6 is an enlarged section though the preferred heat transfer surface configuration in the body of the heat exchanger along line 6—6 of FIG. 3.
Figure 7:
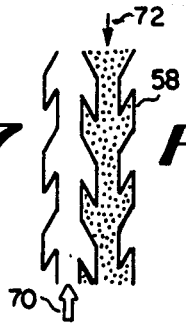
FIG. 7 is an enlarged section through the heat transfer surface near the side bars of the heat exchanger along line 7—7 of FIG. 3.
Figure 8:
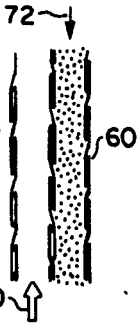
FIG. 8 is an enlarged section through the heat transfer surface at the side bar of the heat exchanger along line 8—8 of FIG. 3.

Since the peripheral edges of the corrugated sheets are flattened to permit contact with the side and end bars, a brazed construction can be facilitated. The flat edge may be generated by forming the corrugations in the central zone of a flat plate, or preferably, by edge rolling of corrugated plates. The rolling of the edge may be carried out in a way such that the flow of liquid in the boiling or condensing channels is preferentially directed in a way to enhance the heat transfer performance. Thus the rolling of the edge is carried out in a direction to produce a downward fold on the condensing side of the sheet, conversely an upward fold is produced on the boiling side. This effect is demonstrated in the sequence of FIGS. 6 through 8 which shows the change of the corrugation form from a generally square cross-section to a flattening of the corrugation at a location immediately adjacent to the side bars, locations 56, 58 and 60 of FIG. 5. Arrow 70 indicates the direction of flow of the boiling fluid through the boiling passage and arrow 72 indicates the direction of flow of the condensing fluid through the condensing passage.

Figure 9:
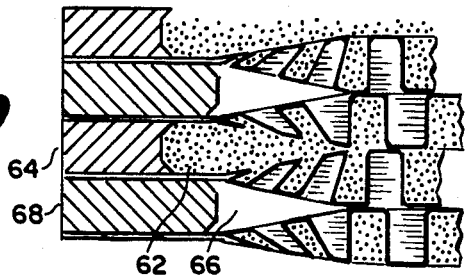
FIG. 9 is an enlarged fragmentary view detailing the side bars of FIG. 5.

With reference to FIG. 9, part of the condensed liquid flowing on the corrugated surface drains towards the side bars along the angle of the corrugation. The downward rolled surface direction causes this liquid to drain freely downward adjacent to the side bar. This is assisted by providing an open flow channel 62 adjacent to the side bar wherein a reentrant side bar 64 provides an extended opening.

On the boiling side of the sheet, two different results are obtained depending upon the direction of the boiling flow. For upward boiling flow as in a conventional thermosyphon arrangement, the upward folding of the metal sheet causes no flow obstruction and liquid and vapor may flow freely upward with no risk of dry-out.

For downward boiling flow, as in a downflow reboiler arrangement, liquid arriving in the area of the side bar from flow along the downward inclined diagonal corrugation of one sheet will collect in the upward folds of the sheets and be redistributed into the body of the exchanger along downward inclined corrugatons of the other sheet. This acts to continuously redistribute liquid and thus prevent surface dryout which would be deleterious to performance and hazardous in the case of oxygen boiling. In this case, side bars (e.g. 68) are formed with a projection to minimize the flow area 66 of the boiling channel adjacent to the side bar.

The corrugated plates may be formed from any thermally conductive material, preferably, aluminum or stainless steel, and clad with a brazing alloy which when heated under vacuum will melt and flow to seal the joints between the plates and the side and end bars. This produces a mechanically sound construction of the same form as a conventional brazed aluminum heat exchanger.

The resultant heat exchanger can operate with downflow of the vapor and liquid on the condensing side and with either upflow or downflow of the liquid and vapor on the boiling side.

The resultant heat exchanger, when utilized as the condenser or reboiler of an air separation (i.e. cryogenic) distillation column, allows for a reduction of the temperature difference at a given heat flux. And, although not intending to be bound by any particular theories, the reasons for this reduction in the temperature difference can be explained as follows:

(1) The heat exchanger design provides an increase of the effective heat transfer surface area between the boiling and condensing channels when compared to the conventional plate-fin core.

(2) Turbulence generated by vapor flow in the tortuous path down the surface disrupts the liquid condensate film by creating circulating eddies and enhances the condensing heat transfer coefficients in a manner similar to the enhancement of single phase heat transfer which is observed with corrugated surfaces.

(3) Condensate arriving at the edge of the heat exchanger along the downward inclined corrugations will flow preferentially down the edge channel thus providing continuous internal condensate drainage. This promotes heat transfer by maintaining a thin liquid film.

For the special case of a downflow reboiler in which the boiling liquid flows as a film down the corrugated surface, liquid arriving at the edge of the exchanger will be captured in the upward facing cavity formed during fin rolling and will be reflected back into the bulk of the exchanger boiling passage along the opposing downward inclined corrugation. This ensures liquid redistributon and prevents the possibility of dryout of the boiling surface. Downflow reboiler operation permits a substantial reduction of operating temperature difference when compared to a thermosyphon operation, i.e. upflow of the liquid and the vapor on the boiling side. This improvement is due to the elimination of the temperature pinch and subcooled liquid heat transfer occurring in the thermosyphon as a result of a pressure gradient in the boiling passage. It is feasible to see an improvement of about 30 to about 40% in the temperature difference reduction utilizing the downflow reboiler configuration.

Additionally, the exchanger is especially suited to the application of an enhanced boiling surface on the extended primary surface formed by the corrugations. Thus a combination benefit of additional area and improved heat transfer coefficient can be obtained. An enhanced surface of the porous type can be placed on the boiling sides of the corrugated sheet by techniques such as flame spraying or powder brazing before assembly and final brazing of the complete unit.

Finally, based on the above description, it is a feature of this invention to incorporate open boiling passages and closed condensing passages with a brazed construction into the heat exchanger design whereby taking advantage of the surface in reboiler-condenser service.

It is another feature of this invention to use a junction design between the corrugated sheets and the side bar to promote condensate drainage and reduce liquid film thickness while simultaneously providing boiling liquid redistribution for the downward boiling flow in the adjacent heat transfer channel.

It is still another feature of this invention to use an enhanced boiling surface on the extended heat transfer surface of the boiling channels.

Lastly, it is a feature of this invention when used in a downflow boiling service to provide a design whereby the liquid is continuously uniformly redistributed to avoid the possibility of dry boiling. In this service a liquid distributor system would be placed above the open boiling channels at the top of the exchanger to provide the liquid downflow.

The present invention has been described with reference to a preferred embodiment thereof. However, this embodiment should not be considered a limitation on the scope of the invention, which scope should be ascertained by the following claims.

I claim:

1. A heat exchanger for reboiler or condenser service which comprises:

a plurality of rectangular corrugated sheets of thermally conductive material having the corrugations with longitudinal axes generally parallel to a diagonal between opposite corners of each sheet and with peripheral vertical edges of each of said sheets being flattened progressively, said flattened vertical edges forming downward folds of the corrugations on the parallel vertical edges of one side of said sheet and upward folds of the corrugations on the parallel vertical edges of the other side of said sheet, said sheets assembled and joined in a stack with each sheet having the longitudinal axes of its corrugation diagonal at an acute angle to the longitudinal axes of its neighbor sheet and having its downward folds facing the downward folds of its neighbor sheet and its upward folds facing the upward folds of its neighbor sheet, thereby forming alternating boiling and condensing passageways between said stacked sheets, wherein said boiling passageways are between said sheets with upward folds facing each other and said condensing passageways are between said sheets with downward folds facing each other, said corrugations forming extended primary heat transfer surfaces;

first means for closing a substantial portion of the parallel vertical edges between alternating pairs of sheets with said downward folds facing each other, wherein said first means in closing the edges leaves an inlet space in an upper portion of one of the parallel edges and an outlet in a lower portion of one of the parallel edges;

second means for closing the entire length of the parallel edges perpendicular to the edges closed by the first means; and third means for closing the entire length of the parallel edges between the alternating sheets partially closed by said first means and having said upward folds facing each other.

2. A heat exchanger for reboiler or condenser service comprising:

an enclosed structure having a plurality of parallel, elongated, thin passageways positioned adjacent one to another, each adjacent passageway sharing along its elongated dimension a common wall made of thermally conductive material having corrugations as subsequently defined, with every alternate passageway communicating at the ends of their elongated dimension so as to form first and second sets of discrete alternating passageways so that material passing through said first set is in indirect heat exchange relationship with material passing through said second set, said structure when in service being positioned so that its elongated dimension is along a verticle axis to permit upward flow of fluid through one set of passageways and downward flow of fluid through the other;

at least one pair of manifolds connecting the upper and lower ends, respectively, of at least one set of said passageways; and inlet or outlet means cooperatively connected to each of said manifolds;

said corrugations extending across the faces of each wall in parallel relationship and in a generally diagonal direction with respect to said vertical axis, the corrugations of adjacent walls running in opposite diagonal directions, said corrugations being flattened progressively toward each vertical edge in a manner forming upward folds on one face of each wall and downward folds on the other face; and said walls being positioned so that the faces having the upward folds define one set of passageways and the faces having downward folds define the other set, said heat exchanger when in service using the set of passageways having upwardly fold corrugations for boiling and the set with downwardly folded corrugations for condensing in the indirect transfer of heat between passing fluids.

3. The heat exchanger of claim 1 which further comprises an enchanced boiling surface applied to the extended primary surface of the boiling channels formed by said corrugations.

4. The heat exchanger of claim 1 wherein said thermally conductive material is aluminum.

5. The heat exchanger of claim 3 wherein said thermally conductive material is aluminum.

6. The heat exchanger of claim 1 wherein said thermally conductive material is stainless steel.

7. The heat exchanger of claim 3 wherein said thermally conductive material is stainless steel.

8. The heat exchanger of claim 1 wherein said means for joining said corrugated sheets is brazing with a brazing alloy under a vacuum.

9. The heat exchanger of claim 3 wherein said means for joining said corrugated sheets is brazing with a brazing alloy under a vacuum.

10. The heat exchanger of claim 1 wherein said corrugated sheets have a corrugation dimension of 3 to 8 corrugations per inch with each corrugation being 0.05 to 0.2 inches in height.

* * * * *

UNITED STATES PATENT AND TRADEMARK OFFICE

CERTIFICATE OF CORRECTION

PATENT NO. : 4,699,209

DATED : October 13, 1987

INVENTOR(S) : Robert M. Thorogood

It is certified that error appears in the above-identified patent and that said Letters Patent is hereby corrected as shown below:

Column 6, Line 54
Delete "fold" and substitute therefor --folded--

Signed and Sealed this

Seventh Day of June, 1988

*Attest:*

DONALD J. QUIGG

*Attesting Officer*

*Commissioner of Patents and Trademarks*